US007462978B1

(12) United States Patent
Schmitkons et al.

(10) Patent No.: US 7,462,978 B1
(45) Date of Patent: Dec. 9, 2008

(54) APPARATUS AND METHOD FOR GENERATING ULTRAVIOLET RADIATION

(75) Inventors: James W. Schmitkons, Lorain, OH (US); James M. Borsuk, Westlake, OH (US)

(73) Assignee: Nordson Corporation, Westlake, OH (US)

( * ) Notice: Subject to any disclaimer, the term of this patent is extended or adjusted under 35 U.S.C. 154(b) by 1555 days.

(21) Appl. No.: 10/088,464

(22) PCT Filed: Sep. 15, 2000

(86) PCT No.: PCT/US00/25282

§ 371 (c)(1),
(2), (4) Date: Mar. 19, 2002

(87) PCT Pub. No.: WO01/22783

PCT Pub. Date: Mar. 29, 2001

Related U.S. Application Data

(60) Provisional application No. 60/155,028, filed on Sep. 20, 1999.

(51) Int. Cl.
*H01J 27/00* (2006.01)
*H05B 41/24* (2006.01)

(52) U.S. Cl. ..... 313/232; 315/248; 315/39

(58) Field of Classification Search ..... 313/231.31, 313/231.41, 231.61, 232; 315/248, 39, 111.01
See application file for complete search history.

(56) References Cited

U.S. PATENT DOCUMENTS

| | | | | |
|---|---|---|---|---|
| 3,872,349 A | | 3/1975 | Spero et al. | 315/39 |
| 3,911,318 A | | 10/1975 | Spero et al. | 315/39 |
| 4,042,850 A | | 8/1977 | Ury et al. | 315/39 |
| 4,504,768 A | | 3/1985 | Ury et al. | 315/248 |
| RE32,626 E | * | 3/1988 | Yoshizawa et al. | 315/39 |
| 4,928,040 A | | 5/1990 | Uesaki | 315/248 |
| 4,990,789 A | | 2/1991 | Uesaki | 250/504 |
| 5,039,918 A | | 8/1991 | Ohtake et al. | 315/248 |

FOREIGN PATENT DOCUMENTS

| | | |
|---|---|---|
| FR | 3452 | 4/1989 |

* cited by examiner

*Primary Examiner*—Joseph L Williams
(74) *Attorney, Agent, or Firm*—Wood, Herron & Evans LLP

(57) ABSTRACT

An apparatus (10) for generating ultraviolet radiation includes a pair of magnetrons (12) coupled to a longitudinally extending microwave chamber (14) for generating standing microwave energy waves within the chamber (14). Microwave energy from the magnetrons (12) is directly coupled to the microwave chamber (14) without the use of coupling slots, antennas or other coupling structures. A longitudinally extending electrodeless plasma bulb (20) is mounted within the microwave chamber (14) and is operable to emit ultraviolet radiation (24) in response to excitation by the microwave energy generated by the pair of magnetrons (12). The microwave chamber (14) includes a pair of longitudinally extending tuning walls (42) positioned on opposite sides of the plasma lamp bulb (20) and capable of overlapping the standing microwave energy waves generally along the longitudinal length of the plasma bulb (20).

29 Claims, 4 Drawing Sheets

APPARATUS AND METHOD FOR GENERATING ULTRAVIOLET RADIATION

CROSS-REFERENCE

The present application claims the filing benefit of provisional application U.S. Ser. No. 60/155,028 filed Sep. 20, 1999, the disclosure of which is hereby incorporated herein by reference in its entirety.

FIELD OF THE INVENTION

The present invention relates generally to ultraviolet radiation generators and, more particularly, to a method and apparatus for generating ultraviolet radiation through excitation of a plasma bulb mounted within a microwave chamber.

BACKGROUND OF THE INVENTION

Ultraviolet radiation generators are known for coupling microwave energy to an electrodeless lamp, such as an ultraviolet (UV) plasma bulb mounted within a microwave chamber of an ultraviolet lamp system. In ultraviolet lamp drying (heating) and curing applications, one or more magnetrons are typically provided in the lamp system to couple microwave radiation to the plasma bulb mounted within the microwave chamber. The magnetrons are coupled to the microwave chamber through one or more waveguides that include output ports connected to an upper end of the chamber. The microwave chamber has coupling slots or antennas positioned at or near the outlet ports of the waveguides for coupling the microwave radiation to the plasma bulb. When the plasma bulb is sufficiently excited by the microwave energy, it emits ultraviolet radiation through a bottom end of the microwave chamber toward a substrate to be irradiated. While the coupling slots or antennas are capable of coupling the microwave energy into the microwave chamber, they have a known drawback of creating fringe energy fields that form potentially damaging regions of concentrated microwave energy near the ends of the bulb. The fringe energy fields generated in the vicinity of the coupling structures act aggressively with the plasma bulb to cause local heating of the bulb envelope near the ends of the bulb. This localized heating of the bulb envelope generally shortens the bulb's operating life.

Typically, the microwave chamber of the UV lamp system includes a mesh screen mounted to the bottom end of the chamber that is transmissive to ultraviolet radiation but is opaque to microwaves. UV lamp systems used in curing of adhesives, sealants or coatings, for example, typically include a reflector mounted within the microwave chamber that is operable to focus the emitted ultraviolet radiation in a predetermined pattern toward the substrate to be irradiated. The reflector may be metallic and form part of the microwave chamber or, alternatively, may comprise a coated glass reflector mounted within the chamber. It will be appreciated that the terms "upper end" and "bottom end" are used herein to simplify description of the microwave chamber in connection with the orientation of the chamber as shown in the figures. Of course, the orientation of the microwave chamber may change depending on the particular ultraviolet lamp drying (heating) or curing application without altering the structure or function of the microwave chamber in any way.

In UV lamp systems, the efficiency and reliability of the plasma bulb is affected by the uniformity of the microwave field created in the microwave chamber. If regions of the plasma within the bulb are not sufficiently excited by microwave energy, localized areas of minimal ultraviolet radiation may be formed along the longitudinal axis of the plasma bulb, thereby providing a generally non-uniform light output from the plasma bulb. On the other hand, if regions of high local fields are generated in the bulb, such as created by coupling structures formed in the path of the propagating microwave energy, local heating of the bulb envelope may occur that results in shorter bulb life and a reduction in bulb performance and reliability.

Accordingly, there is a need for an ultraviolet radiation generator that couples microwave energy to a plasma bulb in a controlled and efficient manner. There is also a need for an ultraviolet radiation generator that improves the light output uniformity of the plasma bulb along its longitudinal length. There is yet also a need for an ultraviolet radiation generator that improves bulb life by reducing the occurrence of potentially damaging high local fields along the length of the plasma bulb.

SUMMARY OF THE INVENTION

The present invention overcomes the foregoing and other shortcomings and drawbacks of ultraviolet radiation generators and methods for generating ultraviolet radiation heretofore known. While the invention will be described in connection with certain embodiments, it will be understood that the invention is not limited to these embodiments. On the contrary, the invention includes all alternatives, modifications and equivalents as may be included within the spirit and scope of the present invention.

An ultraviolet radiation generator or light source in accordance with a preferred embodiment of the present invention includes a pair of microwave generators or magnetrons that are directly coupled through waveguides to a longitudinally extending microwave chamber. Microwave energy is "dumped", i.e., directly coupled without restriction, into the microwave chamber without the use of coupling slots, antennas or other coupling structures. The direct "dumping" of the microwave energy into the microwave chamber enhances the starting ability of the light source as well as reducing the formation of potentially damaging zones of concentrated microwave energy near the ends of the plasma bulb.

The microwave chamber is capable of supporting standing microwave energy waves generated by the pair of magnetrons along its longitudinal length. A longitudinally extending electrodeless plasma bulb is mounted within the microwave chamber and is operable to emit ultraviolet radiation from the chamber in response to excitation of the bulb by the microwave energy generated by the pair of magnetrons. A glass reflector is mounted within the microwave chamber and is configured to reflect ultraviolet radiation emitted from the plasma bulb toward a substrate to be irradiated.

The microwave chamber includes a pair of end walls, a pair of side walls extending longitudinally between the pair of end walls, and a top wall. In accordance with the principles of the present invention, the microwave chamber further includes a pair of longitudinally extending tuning walls positioned on opposite sides of the plasma bulb that extend inwardly and upwardly from the side walls toward the top wall. The inward tilting of the tuning walls effectively narrows the side walls of the microwave chamber adjacent the plasma bulb to cause overlapping of the standing microwave energy waves within the chamber generally along the longitudinal length of the plasma bulb. By altering the inward tilting of the tuning walls, or by altering the horizontal and vertical extents of the tuning walls, the extent of overlapping of the standing microwave energy waves may be adjusted within the microwave chamber. Further, by varying the length of the waveguides, the impedance matching between the magnetrons and the microwave chamber can be adjusted so that an optimum amount of microwave energy generated by the magnetrons is absorbed by the plasma bulb.

The tuning walls of the microwave chamber cause "hot zones" produced by one of the magnetrons to be phase shifted with respect to "hot zones" produced by the other magnetron to prevent direct overlapping of the respective "hot zones" produced by the pair of magnetrons which may otherwise damage the plasma bulb. To improve bulb performance, the respective "hot zones" produced by the pair of magnetrons are generally spaced along the length of the bulb so that the bulb is generally uniformly excited along its length. In accordance with a preferred embodiment of the present invention, the "hot zones" of one magnetron are generally superimposed with "cool zones" produced by the other magnetron to produce a resulting series of generally uniform "energy zones" spaced along the length of the plasma bulb.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
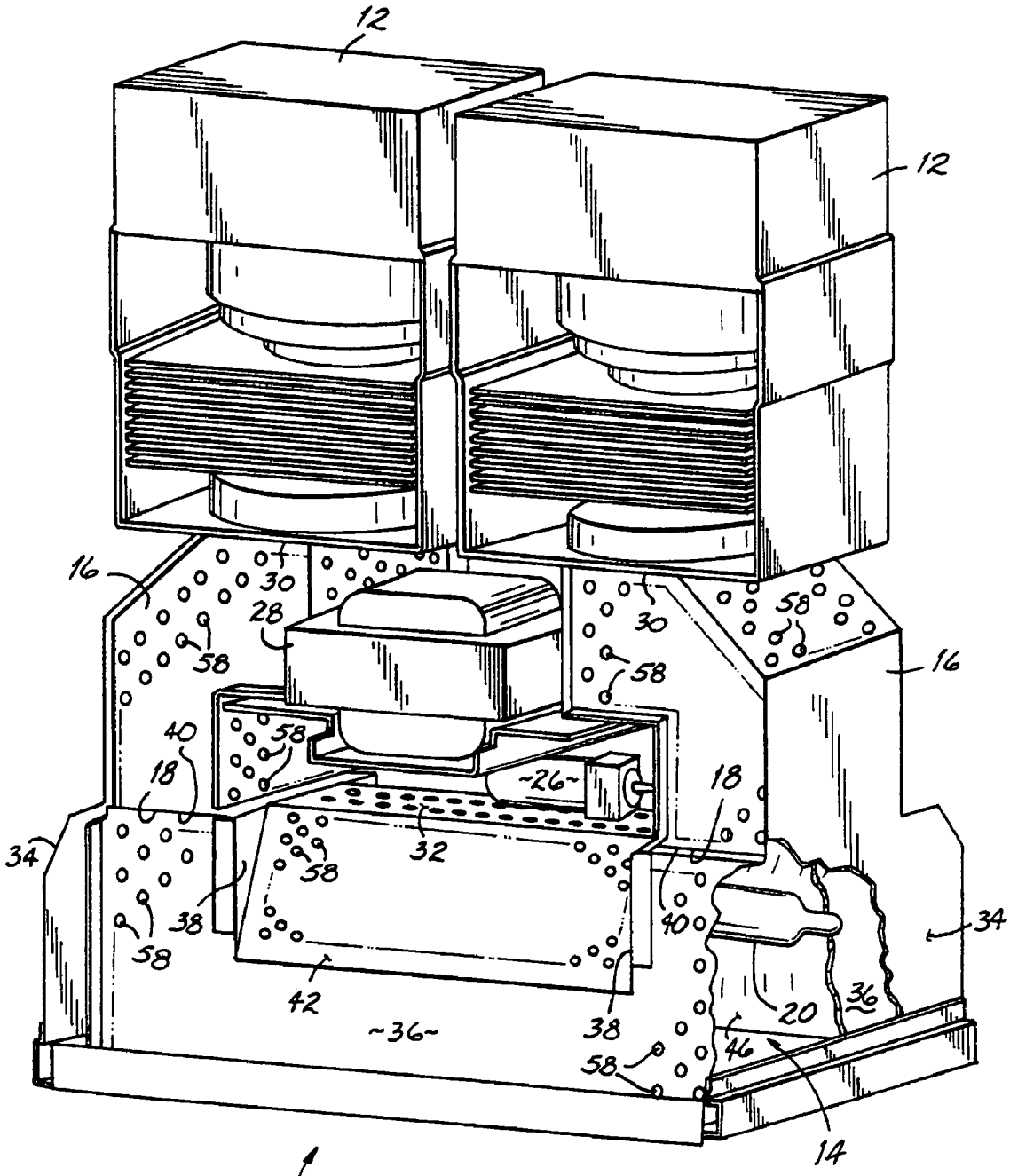
FIG. 1 is a perspective view of an ultraviolet radiation generator in accordance with the principles of the present invention.

With reference to the figures, an microwave ("UV") radiation generator or light source 10 is shown in accordance with the principles of the present invention. Light source 10 includes a pair of microwave generators, illustrated as a pair of magnetrons 12, that are each coupled to a longitudinally extending microwave chamber 14 through a respective waveguide 16. Each waveguide 16 has an outlet port 18 coupled to an upper end of the microwave chamber 14 so that microwaves generated by the pair of microwave generators 12 are directly coupled to the microwave chamber 14 in spaced longitudinal relationship adjacent opposite upper ends of the chamber 14. The microwave energy conduit defined by each waveguide 16 is unrestricted at its entry into the microwave chamber 14 so that the microwaves are "dumped", i.e., directly coupled without restriction, into the chamber 14 without the use of coupling slots, antennas or other coupling structures.

An electrodeless plasma bulb 20, in the form of a sealed, longitudinally extending plasma bulb, is mechanically mounted within the microwave chamber 14 and supported adjacent the upper end of the chamber 14 as is well known in the art. While not shown, it will be appreciated that light source 10 is mechanically mounted within a cabinet or housing well known to those of ordinary skill in the art that includes the necessary pressurized cooling air and electrical connections for operation of the light source 10. As will be described in greater detail below, light source 10 is designed and constructed to emit ultraviolet radiation, illustrated diagrammatically at 24 (FIG. 2) from a bottom end of the microwave chamber 14 upon sufficient excitation of the plasma bulb 20 by microwave energy coupled to the microwave chamber 14 from the pair of microwave generators 12.

More particularly, light source 10 includes a starter bulb 26, and a pair of transformers 28 that are each electrically coupled to a respective one of the magnetrons 12 to energize filaments of the magnetrons 12 as understood by those skilled in the art. The magnetrons 12 are mechanically mounted to inlet ports 30 of the waveguides 16 so that microwaves generated by the magnetrons 12 are discharged into the chamber 14 through the longitudinally spaced apart outlet ports 18 of the waveguides 16. Preferably, the frequencies of the two magnetrons 12 are split or offset by a small amount to prevent intercoupling between them during operation of the light source 10. For example, magnetrons 12 may each have an output power rating of about 3 KWatt, with one of the magnetrons 12 operating at a frequency of about 2443 MHz and the other magnetron 12 operating at a frequency of about 2465 MHz. Of course, other magnetron output power ratings and operating frequencies are possible without departing from the spirit and scope of the present invention.

In one embodiment of the present invention, microwave chamber 14 is constructed generally as a rectangular chamber for supporting standing microwave energy waves along its longitudinal length. Thus, according to the principles of the present invention, the standing microwave energy waves generated by the pair of magnetrons 12 within the microwave chamber 14 are generally aligned along the longitudinal length of the plasma bulb 20 to thereby create a resulting microwave energy field that generally uniformly excites the bulb 20 along its length as will be described in more detail below in connection with FIGS. 3A-3C.

Figure 2:
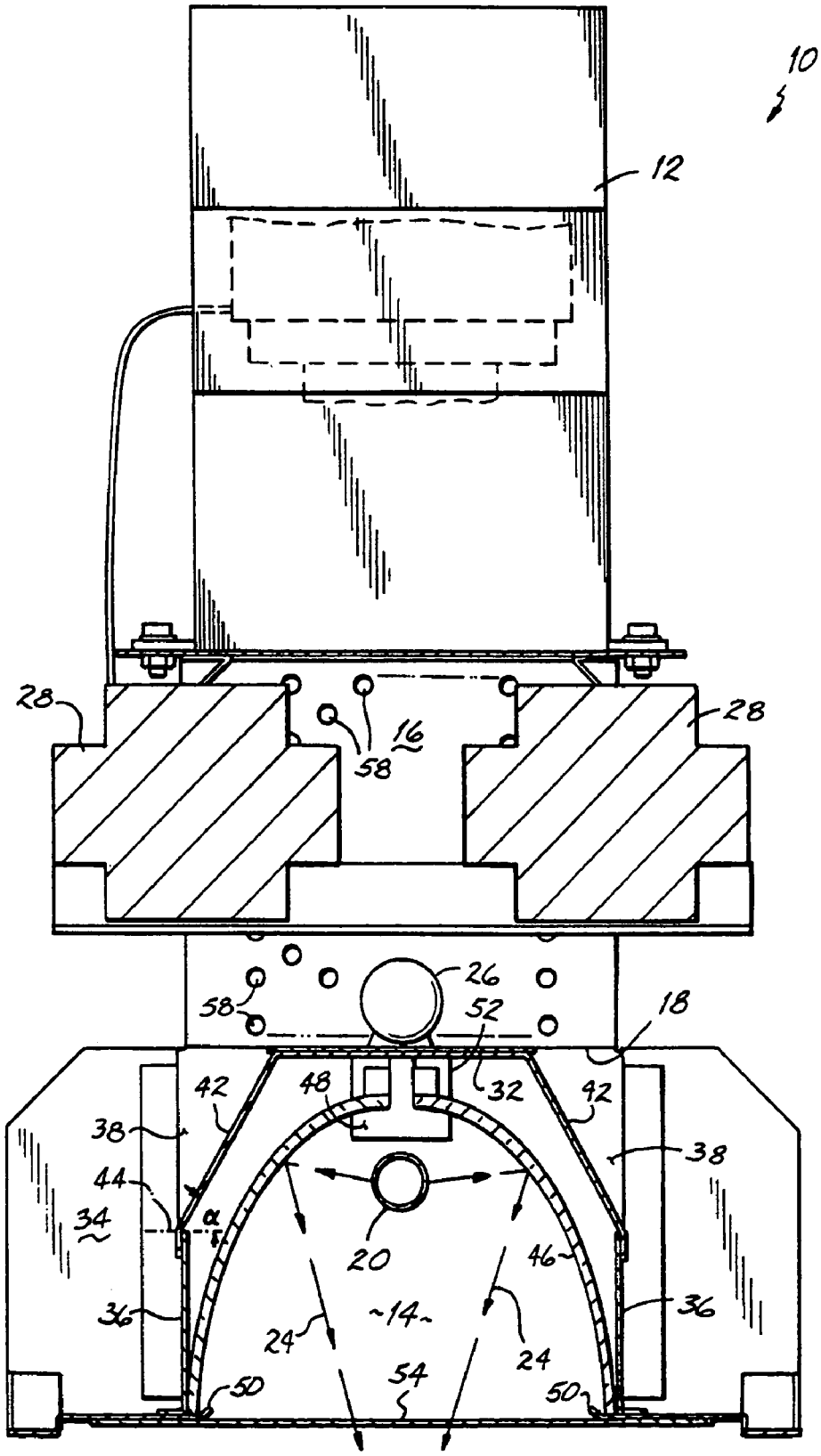
FIG. 2 is a cross-sectional view of the ultraviolet radiation generator taken along line 2-2 of FIG. 1.

As best understood with reference to FIGS. 1 and 2, microwave chamber 14 includes a generally horizontal top wall 32, a pair of generally vertical opposite end walls 34, and a pair of generally vertical opposite side walls 36 that extend longitudinally between the end walls 34 and on opposite sides of the plasma bulb 20. Two (2) pairs of generally vertical inner walls 38 are spaced from and parallel to the end walls 34. The end walls 34, side walls 36 and inner walls 38 form a pair of openings 40 at an upper end of the microwave chamber 14 that are aligned with and directly coupled to the outlet ports 18 of the waveguides 16. Each opening 40 has a cross-sectional area that is substantially equal to the cross-sectional area of each outlet port 18. In this way, the microwave energy generated by each magnetron 12 is "dumped", i.e., directly coupled without restriction, to the microwave chamber 14 without the use of coupling slots, antennas or other coupling structures. In this way, the direct "dumping" of the microwave energy into the microwave chamber 14 enhances the starting ability of the light source 10 as well as reducing the formation of potentially damaging zones of concentrated microwave energy near the ends of the plasma bulb 20 that may damage the bulb. While not shown, it is contemplated in an alternative embodiment of the present invention that the outlet ports 18 of the waveguides 16 may enter the microwave chamber 14 through the opposite end walls 34 of the chamber 14 without departing from the spirit or scope of the present invention.

Figure 2A:
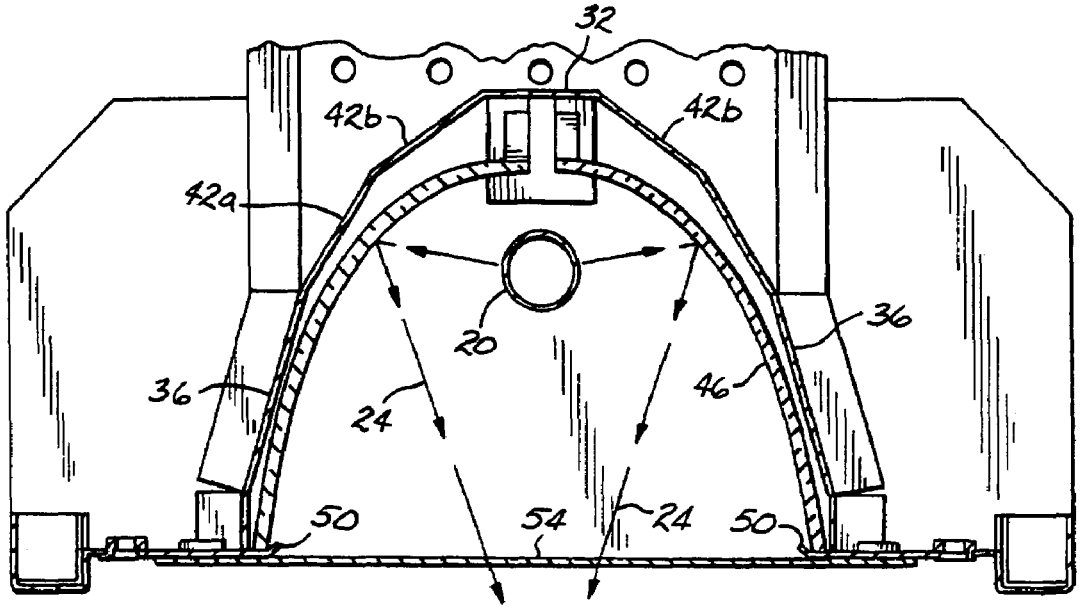
FIG. 2A is a partial cross-sectional view similar to FIG. 2 illustrating an ultraviolet radiation generator in accordance with an alternative embodiment of the present invention.

Microwave chamber 14 further includes a pair of longitudinally extending, generally planar tuning walls 42 that extend upwardly and inwardly from the side walls 36 toward the top wall 32, and are positioned between the opposite pairs of the vertical inner walls 38. In this way, the tuning walls 42 are positioned between the openings 40 of the microwave chamber 14 and on opposite sides of the plasma bulb 20 to effectively narrow the side walls 36 of the chamber 14 adjacent the plasma bulb 20. By narrowing the side walls 36 adjacent the bulb 20, the tuning walls 42 operate to overlap or superimpose the respective standing waves generated by the pair of magnetrons 12 as described in detail below. Alternatively, as shown in FIG. 2A, each of the tuning walls on opposite sides of the plasma bulb 20 may comprise multiple wall segments 42*a* and 42*b* that tilt inwardly from the side walls 36 toward the top wall 32 to effectively narrow the side walls 36 of chamber 14 adjacent the plasma bulb 20. While not shown, it is contemplated in yet another alternative embodiment of the present invention that the tuning walls could be curved to extend inwardly from the side walls 36 toward the top wall 32 to provide the desired effective narrowing of the microwave chamber 14 adjacent opposite sides of the plasma bulb 20.

In one embodiment of the present invention, as shown in FIGS. 1 and 2, the microwave chamber 14 has a longitudinal length of about 10", a width of about 4.21" and a height of about 3.50". The tuning walls 42 tilt inwardly from the side walls 36 at an angle "α" (FIG. 2) of about 60° relative to a plane 44 generally perpendicular to the side walls 36, although other dimensions of the chamber 14 and angles "α" of the tuning walls 42 are possible without departing from the spirit and scope of the present invention. By altering the inward angle "α" of the tuning walls 42, or by altering the horizontal and vertical extents of the tuning walls 42, the extent of overlapping of the standing energy waves generated by the pair of magnetrons 12 may be adjusted within the microwave chamber 14 as described in detail below.

Still referring to FIGS. 1 and 2, the light source 10 includes an elliptical glass reflector 46 mounted within the microwave chamber 14 through longitudinally spaced apart retainers 48, and has its lower end supported on generally horizontal, inwardly directed flanges 50 of the light source 10. It will be appreciated that other cross-sectional configurations of reflector 46 are possible for varying the reflected radiation pattern without departing from the spirit and scope of the present invention. Reflector 46 is transparent to the microwave energy generated by the magnetrons 12 and reflects ultraviolet radiation 24 emitted from the plasma bulb 20 toward a substrate (not shown) to be irradiated as will be appreciated by those skilled in the art. A mesh screen 54 is mounted to the bottom end of the microwave chamber 14 that is transparent to the emitted ultraviolet radiation 24 while remaining opaque to the generated microwaves. The waveguides 16 and microwave chamber 14 are welded or otherwise connected together to form an integral unit for supporting the starter bulb 26, filament transformers 28 and magnetrons 12. The waveguides 16, top wall 32, end walls 34, side walls 36, inner walls 38 and tuning walls 42 are metallic and serve as reflectors to the microwave energy coupled to microwave chamber 14 by the magnetrons 12. As illustrated in the figures, each of the waveguides 16, top wall 32, end walls 34, side walls 36 and tuning walls 42 includes apertures 58 to permit cooling air to be passed through the light source 10.

In operation, it is desirous to obtain a generally uniform microwave energy field along the longitudinal length of the plasma bulb 20. When a standing wave pattern is generated within the microwave chamber 14, the plasma bulb 20 is subjected to concentrated microwave energy fields that are longitudinally spaced along the length of the plasma bulb 20. These concentrated microwave energy fields generally coincide with the regions of maximum amplitude (i.e., antinodes) of the standing waves. In those regions of concentrated microwave energy, a resultant concentration of plasma or "hot zone" will be created within the plasma bulb 20, while in the non-concentrated microwave energy regions, "cold zones" within the plasma bulb 20 will result. The "cold zones" generally coincide with the nodes of the standing waves. The alternating "hot zones" and "cool zones" within the plasma bulb 20 may cause non-uniform light output along the axis of the plasma bulb 20 and local heating of the bulb envelope, thereby resulting in shorter bulb life and a reduction in bulb performance and reliability.

Figure 3A:
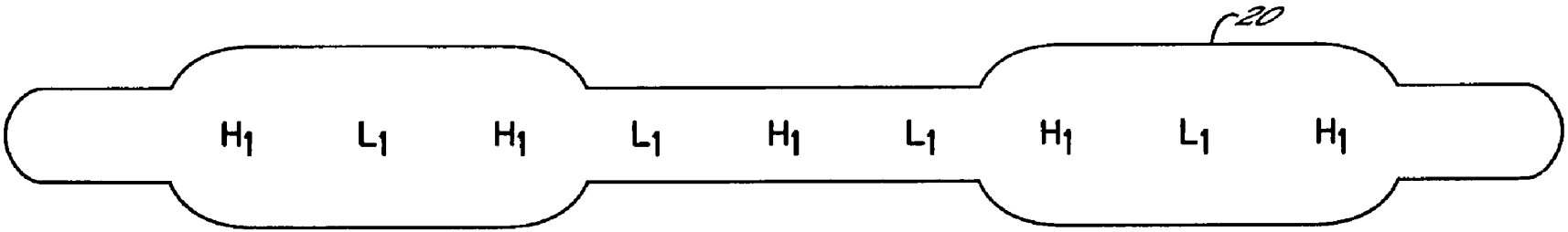
FIG. 3A is a diagrammatic view illustrating an energy distribution pattern generated along the longitudinal length of a plasma bulb as generated by only one of a pair of magnetrons.
Figure 3B:
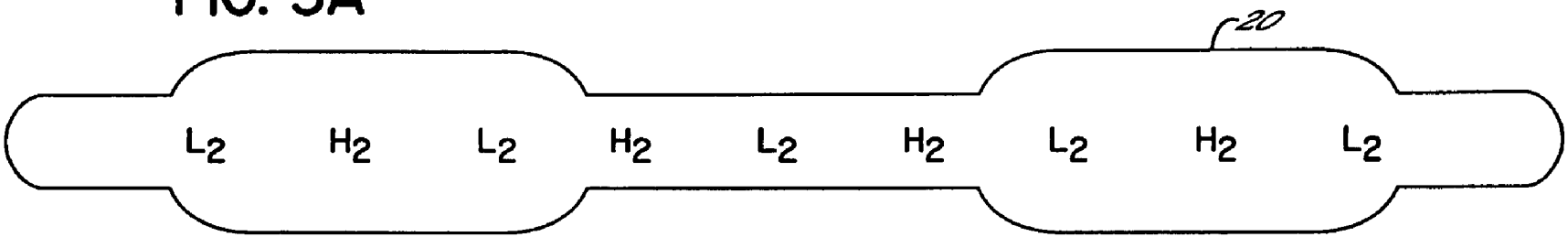
FIG. 3B is a diagrammatic view illustrating an energy distribution pattern generated along the longitudinal length of the plasma bulb by only the other of the pair of magnetrons.
Figure 3C:
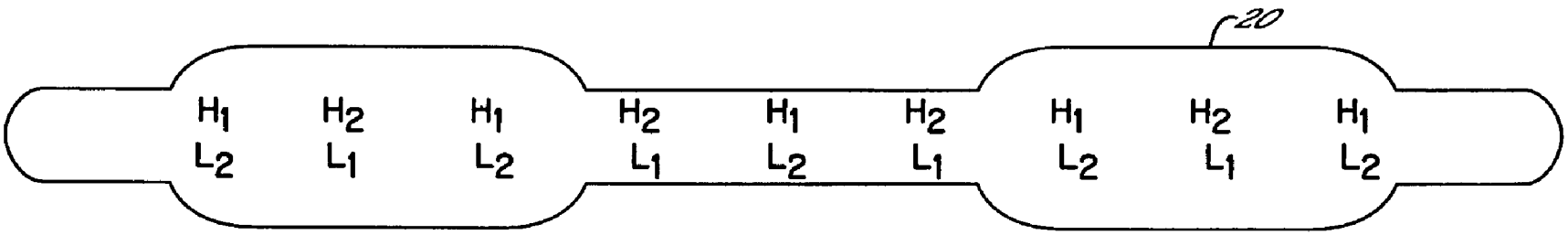
FIG. 3C is a diagrammatic view illustrating an energy distribution pattern generated along the longitudinal length of the plasma bulb by both magnetrons operating simultaneously.

As shown diagrammatically in FIG. 3A-3C, the microwave chamber 14 of present invention takes advantage of the standing microwave energy fields generated by the pair of magnetrons 12 to provide a generally uniform energy field along the axis of the plasma bulb 20. More particularly, the narrowing of the side walls 36 of the microwave chamber 14 through inward tilting of the tuning walls 42 causes overlapping or superimposing of the respective standing waves generated by the pair of magnetrons 12 so that the "hot zones" produced by one of the magnetrons 12 are preferably phase shifted with respect to the "hot zones" produced by the other magnetron to prevent direct overlapping of the respective "hot zones" produced by the pair of magnetrons 12 which may otherwise damage the bulb 20. To improve bulb performance, the respective "hot zones" produced by the pair of magnetrons are generally spaced along the length of the bulb 20 so that the bulb is generally uniformly excited along its length.

In accordance with a preferred embodiment of the present invention as shown in FIGS. 3A-3C, the "hot zones" of one magnetron 12 are generally superimposed with the "cool zones" produced by the other magnetron 12 to produce a resulting series of generally uniform "energy zones" spaced along the length of the bulb 20. That is, the antinodes of the standing wave generated by one of the magnetrons 12 is generally superimposed with the node of the standing wave generated by the other magnetron 12. Of course, other phase relationships of the "hot" and "cold" zones produced by the pair of magnetrons 12 are possible without departing from the spirit and scope of the present invention. Most importantly, however, the microwave chamber 14 is constructed so that the antinodes of the standing waves are prevented from directly superimposing themselves on each other, thereby causing undesirable "hot zones" of generally double microwave energy in localized areas of the plasma bulb 20 that may damage the bulb.

As shown in FIG. 3A, the microwave energy field produced by only a first of the magnetrons 12 in operation produces alternating "hot zones ("$H_1$")" and "cool zones ("$L_1$")" along the length of the bulb 20 that correspond generally with the antinodes and nodes. respectively, of the standing wave generated by the single first magnetron 12. Likewise, as shown in FIG. 3B, the microwave energy field produced by only the second magnetron 12 in operation produces alternating "cool zones ("$L_2$")" and "hot zones ("$H_2$")" along the length of the bulb 20 that correspond generally with the nodes and antinodes, respectively, of the standing wave generated by the single second magnetron 12.

With both of the magnetrons 12 powered and in operation, as shown in FIG. 3C, the microwave chamber 14 is pre-tuned by the inwardly tilting tuning walls 42 to cause the "hot zones ("$H_1$")" of the first magnetron 12 to be generally superimposed with the "cool zones ("$L_2$")" of the second magnetron 12, and to cause the "hot zones ("$H_2$")" of the second magnetron 12 to be generally superimposed with the "cool zones ("L1")" of the first magnetron 12. In this way, generally uniform "energy zones ("$H_1/L_2$" and "$H_2/L_1$")" are generated along the length of the bulb 20 as shown diagrammatically in FIG. 3C. It will be appreciated that by altering the angle "α" of the tuning walls 42, and/or by altering the vertical and horizontal extents of the tuning walls 42, the extent of overlapping of the standing waves generated by the pair of magnetrons 12 of the standing waves, can be adjusted to achieve generally uniform "energy zones" along the length of the plasma bulb 20. In addition, it is contemplated that the phase relationship of the standing waves can be further tuned or adjusted by varying the length of each waveguide 16. More particularly, by varying the length of each waveguide 16, the impedance matching between the magnetrons 12 and the microwave chamber 14 can be adjusted so that an optimum amount of microwave energy generated by the magnetrons 12 is absorbed by the plasma bulb 20.

While a pair of magnetrons 12 are shown and described, it will be appreciated that more than two magnetrons may be coupled to the microwave chamber 14 without departing from the spirit and scope of the present invention. In this alternative embodiment of the present invention (not shown), the standing microwave energy wave produced by each of the magnetrons is phase shifted relative to the standing waves produced by the other magnetrons so that the "hot zones" produced by the respective magnetrons do not directly overlap each other and are generally spaced along the length of the bulb 20.

Thus, the microwave chamber 14 of the present invention couples microwave energy from the pair of magnetrons 12 to the plasma bulb 20 in a controlled and efficient manner. The microwave chamber 14 of the present invention also improves the light output uniformity of the plasma bulb 20 along its length by eliminating "cool zones" of limited plasma energy. Moreover, the microwave chamber 14 of the present invention improves bulb life and reliability by reducing the occurrence of potentially damaging "hot zones" in the bulb 20.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, We Claim:

1. An apparatus for generating ultraviolet radiation, comprising:

a longitudinally extending microwave chamber capable of supporting standing microwave energy waves therein:

a longitudinally extending plasma bulb mounted within said microwave chamber;

a pair of microwave generators capable of generating a pair of standing microwave energy waves within said chamber for exciting said plasma bulb to emit ultraviolet radiation from said chamber; and a pair of waveguides each directly coupling a respective one of said pair of magnetrons to said microwave chamber.

2. The apparatus of claim 1 further comprising:

a pair of longitudinally extending tuning walls positioned on opposite sides of said plasma bulb and capable of overlapping said pair of standing microwave energy waves within said chamber generally along the longitudinal length of said plasma bulb.

3. The apparatus of claim 2, wherein said microwave chamber comprises:

a pair of end walls;

a pair of side walls extending longitudinally between said pair of end walls;

a top wall; and said pair of tuning walls extending inwardly and upwardly from said pair of side walls toward said top wall.

4. The apparatus of claim 3, wherein each of said tuning walls comprises a generally planar wall extending inwardly and upwardly from one of said side walls toward said top wall.

5. The apparatus of claim 3, wherein each of said tuning walls comprises at least two generally planar walls extending inwardly and upwardly from one of said side walls toward said top wall.

6. The apparatus of claim 1 wherein said microwave chamber has a pair of openings formed therein and each of said waveguides has an outlet port communicating directly with one of said openings in said microwave chamber.

7. The apparatus of claim 6 wherein each of said openings has a cross-sectional area that is substantially equal to a cross-sectional area of one of said outlet ports.

8. The apparatus of claim 6 further comprising:

a pair of longitudinally extending tuning walls positioned on opposite sides of said plasma bulb and capable of overlapping said pair of standing microwave energy waves within said chamber generally along the longitudinally length of said plasma bulb.

9. The apparatus of claim 8, wherein said microwave chamber comprises:

a pair of end walls;

a pair of side walls extending longitudinally between said pair of end walls;

a top wall; and said pair of tuning walls extending inwardly and upwardly from said pair of side walls toward said top wall.

10. The apparatus of claim 9, wherein each of said tuning walls comprises a generally planar wall extending inwardly and upwardly from one of said side walls toward said top wall.

11. The apparatus of claim 9, wherein each of said tuning walls comprises at least two generally planar walls extending inwardly and upwardly from one of said side walls toward said top wall.

12. The method of claim 1 further comprising:

a longitudinally extending, microwave transparent reflector mounted within said microwave chamber and capable of reflecting ultraviolet radiation emitted by said plasma bulb.

13. An apparatus for generating ultraviolet radiation, comprising:

a longitudinally extending microwave chamber;

a longitudinally extending plasma bulb mounted within said microwave chamber;

a pair of microwave generators coupled to said microwave chamber and capable of generating microwave energy waves within said chamber for exciting said plasma bulb to emit ultraviolet radiation from said chamber;

a pair of waveguides each directly coupling a respective one of said pair of magnetrons to said microwave chamber; and a pair of longitudinally extending tuning walls positioned on opposite sides of said plasma bulb and capable of tuning said microwave chamber to generally uniformly excite said plasma bulb along its length.

14. The apparatus of claim 13, wherein said microwave chamber comprises:

a pair of end walls;

a pair of side walls extending longitudinally between said pair of end walls;

a top wall; and said pair of tuning walls extending inwardly and upwardly from said pair of side walls toward said top wall.

15. The apparatus of claim 14, wherein each of said tuning walls comprises a generally planar wall extending inwardly and upwardly from one of said side walls toward said top wall.

16. The apparatus of claim 14, wherein each of said tuning walls comprises at least two generally planar walls extending inwardly and upwardly from one of said side walls toward said top wall.

17. The apparatus of claim 13 wherein said microwave chamber having a pair of openings formed therein and each of said waveguides having an outlet port communicating directly with one of said openings in said microwave chamber.

18. The apparatus of claim 17 wherein each of said openings has a cross-sectional area that is substantially equal to a cross-sectional area of one of said outlet ports.

19. The apparatus of claim 17, wherein said microwave chamber comprises:

a pair of end walls;

a pair of side walls extending longitudinally between said pair of end walls;

a top wall; and said pair of tuning walls extending inwardly and upwardly from said pair of side walls toward said top wall.

20. The apparatus of claim 19, wherein each of said tuning walls comprises a generally planar wall extending inwardly and upwardly from one of said side walls toward said top wall.

21. The apparatus of claim 19, wherein each of said tuning walls comprises at least two generally planar walls extending inwardly and upwardly from one of said walls toward said top wall.

22. The method of claim 13 further comprising:

a longitudinally extending, microwave transparent reflector mounted within said microwave chamber and capable of reflecting ultraviolet radiation emitted by said plasma bulb.

23. A method for generating ultraviolet radiation from a plasma bulb mounted longitudinally within a microwave chamber, comprising:

generating microwave energy waves from at least two sources; and directly coupling the microwave energy waves into the microwave chamber for creating microwave energy waves longitudinally within the microwave chamber that excite the plasma bulb to emit ultraviolet radiation from the chamber.

24. The method of claim 23, further comprising:

overlapping the standing microwave energy waves within the chamber generally along the longitudinal length of the plasma bulb.

25. The method of claim 23, further comprising:

adjusting the phase relationship of the standing microwave energy waves within the microwave chamber.

26. The method of claim 24, further comprising:

adjusting the phase relationship of the standing microwave energy waves within the microwave chamber.

27. The method of claim 23, further comprising:

overlapping the standing microwave energy waves within the chamber generally along the longitudinal length of the plasma bulb.

28. The method of claim 27, further comprising:

adjusting the phase relationship of the standing microwave energy waves within the microwave chamber.

29. The method of claim 23, further comprising:

adjusting the phase relationship of the standing microwave energy waves within the microwave chamber.

* * * * *

UNITED STATES PATENT AND TRADEMARK OFFICE

CERTIFICATE OF CORRECTION

PATENT NO. : 7,462,978 B1
APPLICATION NO. : 10/088464
DATED : December 9, 2008
INVENTOR(S) : James W. Schmitkons et al.

It is certified that error appears in the above-identified patent and that said Letters Patent is hereby corrected as shown below:

In column 3, line 55, change “microwave” to --ultraviolet--.

In column 6, line 63, change “.” to --,--.

In column 7, Claim 1, line 63, change “:” to --;--.

In column 8, Claim 8, line 39, change “longitudinally” to --longitudinal--.

Signed and Sealed this

Fourth Day of August, 2009

JOHN DOLL
*Acting Director of the United States Patent and Trademark Office*